US005818342A

United States Patent [19]

Solomon et al.

[11] Patent Number: 5,818,342

[45] Date of Patent: Oct. 6, 1998

[54] AUDIO RESPONSIVE VISUAL DEVICE

[76] Inventors: Lawrence Solomon, 9430 NW. 21st Manor, Sunrise, Fla. 33322; Larry Dinkins, 5940 NW. 14th Ct., Sunrise, Fla. 33313

[21] Appl. No.: 539,019

[22] Filed: Oct. 3, 1995

[51] Int. Cl.[6] ..... G08B 5/00; A63J 17/00; H04R 29/00

[52] U.S. Cl. ..... 340/815.46; 367/199; 381/56; 381/58; 84/464 R

[58] Field of Search ..... 340/815.46, 525, 340/566, 573; 367/197–199; 381/56, 58, 61; 84/464 R

[56] References Cited

U.S. PATENT DOCUMENTS

| | | | |
|---|---|---|---|
| 3,480,912 | 11/1969 | Speeth et al. | 368/197 |
| 3,845,468 | 10/1974 | Smith | 84/464 R |
| 4,185,276 | 1/1980 | Benson | 340/815.46 |
| 4,256,009 | 3/1981 | Verduin et al. | 84/464 R |
| 4,348,666 | 9/1982 | Ogita | 345/39 |
| 4,359,669 | 11/1982 | Anderson | 315/208 |
| 4,440,059 | 4/1984 | Hunter | 84/464 R |
| 4,528,501 | 7/1985 | Dorrough et al. | 324/103 P |
| 4,614,942 | 9/1986 | Molinaro | 340/815.46 |
| 4,771,280 | 9/1988 | Molinaro | 340/815.46 |
| 4,809,584 | 3/1989 | Forrest | 340/815.46 |
| 4,843,627 | 6/1989 | Stebbins | 381/110 |
| 5,083,064 | 1/1992 | Jones, Sr. | 315/294 |
| 5,119,426 | 6/1992 | Roberts | 381/56 |
| 5,191,319 | 3/1993 | Kiltz | 345/73 |
| 5,315,695 | 5/1994 | Saito et al. | 345/432 |
| 5,365,149 | 11/1994 | Blakeslee et al. | 340/815.46 |
| 5,365,219 | 11/1994 | Wong et al. | 340/573 |
| 5,402,702 | 4/1995 | Hata | 84/464 R |
| 5,461,188 | 10/1995 | Drago et al. | 84/464 R |
| 5,501,131 | 3/1996 | Hata | 84/464 R |

*Primary Examiner*—Donnie L. Crosland
*Attorney, Agent, or Firm*—Malin, Haley, DiMaggio & Crosby

[57] ABSTRACT

A device is provided that responds in real time, as well as in a rhythmic fashion, through amplification and processing of an audio signal. The device also will change in intensity. The electronics work off of three DC power supplies derived from a single AC source. The DC power supplies supply DC sources to the lamp voltage, audio amplifier and darlington network. The circuit takes a line (low) level signal into a capacitively coupled audio amplifier IC. The amplified output is then fed through an isolation transformer into a full-wave bridge rectifier to become a pulsed DC to drive the darlington network. The darlington network, used for voltage gain, drives the bases of the lamp driver transistors which are staggered respectively, through diodes to produce the visual effect. The circuit is not limited to driving lamps of any particular wattage or to the housing of the visual display.

19 Claims, 9 Drawing Sheets

AUDIO RESPONSIVE VISUAL DEVICE

BACKGROUND OF THE INVENTION

1. Field of the Invention

The present invention relates generally to a visual device and in more particular to a visual light device which is responsive to audio input signals.

2. Description of the Prior Art

Different visual light devices which are responsive to audio input signals are known in the prior art. U.S. Pat. No. 3,480,912 to issued Speeth et al. discloses a visual sound level indicator for use in a classroom to indicate to a pupil when he or she is speaking loud enough. The indicator has a semi-transparent front panel divided into parallel strips each of a different color with an indicating lamp behind each strip. A microphone and electrical circuit controls the indicator lamps to illuminate the colored strips in succession so as to indicate the level of the pupil's voice.

U.S. Pat. No. 4,614,942 issued to Molinaro describes a visual sound device for use in the visual interpretation of a received electrical sound signal, which has an electro visual means that responds visually in amplitude to the amplitude variations of the intelligence contained within a band of frequencies contained within the frequency spectrum of a received electrical sound signal.

However, the prior art has failed to teach or provide a visual light output which varies in intensity and responds in real time to a received audio input signal. Additionally, other prior art devices have only function in response to a specific instrument (i.e. microphone). Prior art devices have been primarily frequency dependent and with their respective light bulbs typically in an on or off state. It is, therefore, to the effective resolution of the aforementioned problems and shortcomings that the present invention is directed.

SUMMARY OF THE INVENTION

The present invention relates to an audio-visual lighting device which responds in real time through amplification and processing of an audio signal. In addition to responding in real time, the device also lights consecutively and changes in intensity from the audio signal. The lighting portion of the present invention gives off a symmetrically rhythmic response from the processing of the audio signal.

The device works off three DC power supplies derived from a single AC source. The AC source is bridge-rectified and filtered to produce a DC voltage for supplying a lamp voltage. Two other DC voltages supplies are derived through transformers into filtering capacitors to supply power to a lamp output driver and the audio amplification circuitry.

The circuit takes a line level signal into a capacitively coupled audio amplifier IC. The amplified output is then fed through an isolation transformer into a full-wave bridge rectifier and becomes pulsing DC to drive a set of darlington configured transistors. The darlington configured transistors are used for voltage gain and also used one of the DC voltages to drive the bases of the lamp driver transistors which are staggered respectively, through diodes to produce the visual rhythmic effect.

Accordingly, the primary object of the invention is to provide a visual light show that corresponds in real time to a line level audio signal.

Another advantage of the present invention is to provide a visual light show which will correspond to an audio signal received from any type of instrument, amplifier, microphone, home and commercial sound systems and similar sound producing devices.

Another advantage of the present invention is to provide a visual light show that corresponds to an audio signal which is safe to operate.

Another advantage of the present invention is to provide a visual light show that corresponds to an audio signal which is relatively low in cost and easy to manufacture.

Other objects and advantages of this invention will become apparent from the following description taken in conjunction with the accompanying drawings wherein set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

The invention may be better understood by reference to the drawings in which.

DETAILED DRAWINGS OF THE PREFERRED EMBODIMENT

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Figure 1:
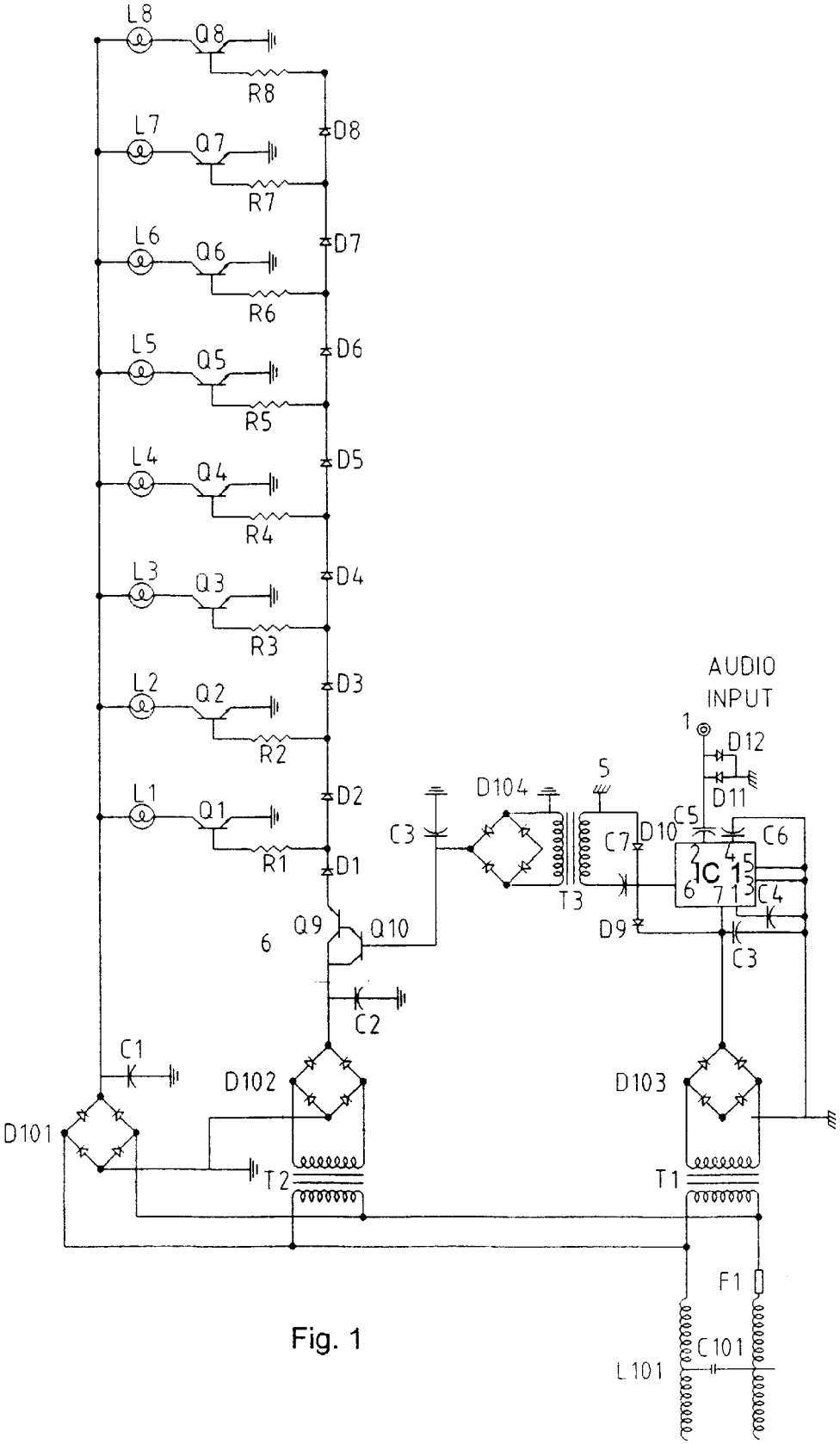
FIG. 1 is a circuit diagram of the first embodiment of the present invention.

Referring to FIG. 1, the electrical circuit of the present invention includes an audio input 1 which will in the preferred embodiment be plugged into the low level pre-in or pre-out of a home or commercial sound system (not shown) for receiving sounds produced by such sound systems and converting them into electrical signals. However, it is to be understood that the audio input can received sounds from a variety of sources and is not limited to strictly home or commercial sound systems. In order to prevent the dangers of shock hazard the present invention is driven by DC power instead of AC.

Preferably, a power source (not shown) produces 120V AC which is fed through a series of prevention components which includes AC line filter L101, capacitor 101 and fuse F1. The various components will be collectively referred to as a prevention network 2. The output side of the prevention network 2 supplies AC voltage to rectifier D101 and transformers T1 and T2 (as will be discussed below). The input to the prevention network 2 is connected to a main AC supply (not shown). AC line filter reduces and/or inhibits any RF traveling on the AC line of the main AC supply. Capacitor C101 is provided for surge purposes and eliminates the spike in the signal which often occurs when initially plugging into an AC line. Fuse F1 is provided for opening the electrical circuit whenever the current therein becomes excessive or otherwise above normal.

The electrical signal from audio input 1 is amplified by a capacitively coupled audio amplifier IC1. The function of audio amplifier IC1, in conjunction with other circuitry of the present invention, is to amplify the weak electrical signal received from audio input 1 to a level capable of driving a lamp output network 3. Audio amplifier IC1 increases the level of the sound signal received by the audio input. The output of audio amplifier IC1 (pin 6) is fed through an audio transformer T3. Transformer T3 isolates the hot ground 4 from the chassis ground 5 to prevent shorting of the hot ground to the cold ground and possibly blowing up the circuitry. The audio signal which is present at the output side of audio transformer T3 is fed into full-wave bridge rectifier D104. The output of rectifier D104 is a pulsed DC signal which is used to drive a darlington driver network 6. Thus, the voltage used to drive the darlington driver network 6 is derived from sound.

Capacitor C5 is coupled to audio amplifier IC1 to block any DC, from defective external sources, from being fed to audio amplifier IC1. This unwanted DC signal, if not blocked, could blow up or otherwise ruin the audio amplifier IC1. Similarly, capacitor C7 blocks any DC present at the output (pin 6) of audio amplifier IC1 from being fed to the isolation transformer T3.

Power for the operation of audio amplifier IC1 is obtained at pin 7 of amplifier IC1 from the DC output of full wave bridge rectifier D103 which is supplied with a input from the output side of transformer T1. Capacitor C3 acts as filtering capacitor of the output of rectifier D103 before such output is supplied to amplifier IC1. Preferably, a 12V DC is derived through transformer T1 and rectifier D103 to drive audio amplifier IC1. The input side of transformer T1 receives the AC source from the output side of hazard prevention network 2.

The lamp output network 3 is shown generally comprising a plurality of Diodes D1–D8, resistors R1–R8, transistors Q1–Q8 and illuminating means or lamps L1–L8. When a control voltage of a particular value is applied to a respective one of the transistor networks than the lamp which is connected to such respective transistor network begins to become illuminated. The lamps L1–L8 are arranged so that they each correspond to a different level of the sound received. However, a previous lamp does not have to be fully illuminated before the next lamp in the sequence begins to be illuminated. The circuit is designed to allow the consecutive illumination of the lamps and also allow the lamps to vary in intensity in conjunction with the varying of the sound level received by the audio input 1.

The lamp output network 3 is connected across the output (the emitter of transistor Q9) of a darlington driver network 6 consisting of transistors Q9 and Q10. The darlington driver network 6 is used for amplifying the pulsed DC signal received from rectifier D104 for driving the lamp output network 3. After being filtered by capacitor C8, the pulsed DC output of rectifier D104 is fed to driver network 6. The value chosen for capacitor C8 is critical in determining the response time and brilliance of the lamps L1–L8. Capacitor C8 allows the audio signal to drive the darlington driver network 6 alot harder without taking away from the response time. Power to the darlington driver network 6, is supplied by the DC output of rectifier D102, after being filtered by capacitor C2. Preferably, 17V DC, which is derived from transformer T2 and rectifier D104, is provided to driver network 6. The input side of transformer T2 receives the AC source from the output side of the hazard prevention network. The darlington network 6, used for voltage gain, uses the 17V DC to drive the bases of the lamp output transistors Q1–Q8, which are staggered through diodes D1–D8, respectively, to produce the visual effect.

The lamp output network 3 receives power from the DC output of rectifier D101 after filtering by capacitor C1. Rectifier D101 receives the AC source directly from the hazard prevention network 2. The isolation transformer T3 is needed, because no transformer is associated with rectifier 101. The isolation transformer T3 isolates the cold ground from the AC line, thus keeping the AC potential from the ground to avoid blowing up the unit.

Diodes D1–D8 are connected in series with each other. A tapping point is provided between each of the diodes and connected to one end of a corresponding one of a plurality of resistors R1–R8. The other end of the resistor is connected to the control base electrode of a corresponding one of a plurality of transistors Q1–Q8. Each of the lamps L1–L8 is connected to the collector of a corresponding transistor. Accordingly, each of the transistors Q1–Q8 and its corresponding connections and components (diodes D1–D8 and resistors R1–R8, respectively) , comprises a control circuit for illuminating lamps L1–L8, respectively.

Rectifiers D101, D102, D103 and D104 are used to obtain DC voltages approximately equal to the total secondary or output voltages of hazard prevention network 2, T2, T1 and T3, respectively. Capacitors C1, C2, C3 and C8 provide filtering of any ripple remaining from AC line still present at the outputs of rectifiers D101, D102, D103 and D104, respectively.

Diodes D11 and D12 are provided for limiting the audio signal going to the audio amplifier IC1 for preventing saturating the input and overdriving amplifier IC1. Thus, audio signal voltages above or below +0.6 or −0.6, respectively, will conduct either diode D12 or diode D11, respectively, causing the diode to act as a short circuit and shunt the audio signal to ground.

Initially, no lamps are illuminated until the output of the darlington driver network is sufficient to conduct diode D1. Upon conduction, diode D1 acts as a short circuit and the output of the darlington driver network triggers Q1 thus commencing illumination of lamp L1. As the sound level increases, further diodes in the lamp output network 3 conduct, thus, causing their respective lamps to be illuminated and lamps in the circuit previously illuminated (L1, etc.) increase and fluctuate in intensity.

In use, sound is converted into an electrical signal by audio input 1 and fed into the capacitively coupled audio amplifier IC1 which amplifies the electrical signal. The amplified signal is then fed through the isolation transformer T3 to the full-wave bridge rectifier D104. The isolation transformer T3 is inserted to prevent shock hazards and isolates the chassis ground 5 from the hot ground 4. Rectifier D104 converts the amplified AC signal to a pulsed DC signal. The pulsed DC signal is fed to the darlington network 6 which amplifies the pulsed DC signal.

When the pulsed DC signal exceeds a voltage of 1.2 volts (0.6 volts to conduct diode D1 and 0.6 volts to overcome the transistor Q1 junction), lamp L1 starts to illuminate. An additional 1.2 volts will begin to illuminate lamp L2. Similarly, each additional 1.2 volts will start to illuminate the next lamp in the lamp output network 3. Furthermore, because the lamps and associated circuitry are connected in parallel to each other, when a voltage is large enough to begin illuminating a lamp in the network 3, the lamps previously lit in network 3 still increase and fluctuate in brightness/intensity from the increase in voltage to the previous lamps. For example, a voltage output of 3.6 volts from the darlington driver network 6, would be seen as 3.6 volts at lamp L1, 2.4 volts at lamp L2 and 1.2 volts at lamp L3.

Accordingly, the present invention is primarily dependent on sound level. As such, the present invention is not limited to a precise frequency bandwidth and will function properly over a broad frequency range (anything in the audio spectrum). The higher the voltage the more lights that will be consecutively illuminated.

The present invention is designed to operate much faster than prior art devices and provides a real time response in a rhythmic fashion to the received audio signal. The present invention can be disposed within housing structures of various sizes and in one use, can be used at nightclubs to provide a visual lighting effect to the dance music heard at such nightclub. However, the present invention is not limited to such use, and it is obvious that various uses for the present invention are virtually unlimited. Additionally, lamps L1–L8 can be of different colors to produce an additional visual effect. Furthermore, the present invention is not limited to the use of eight lamps and will operate with the desired results with more or less than eight lamps.

Figure 2A:
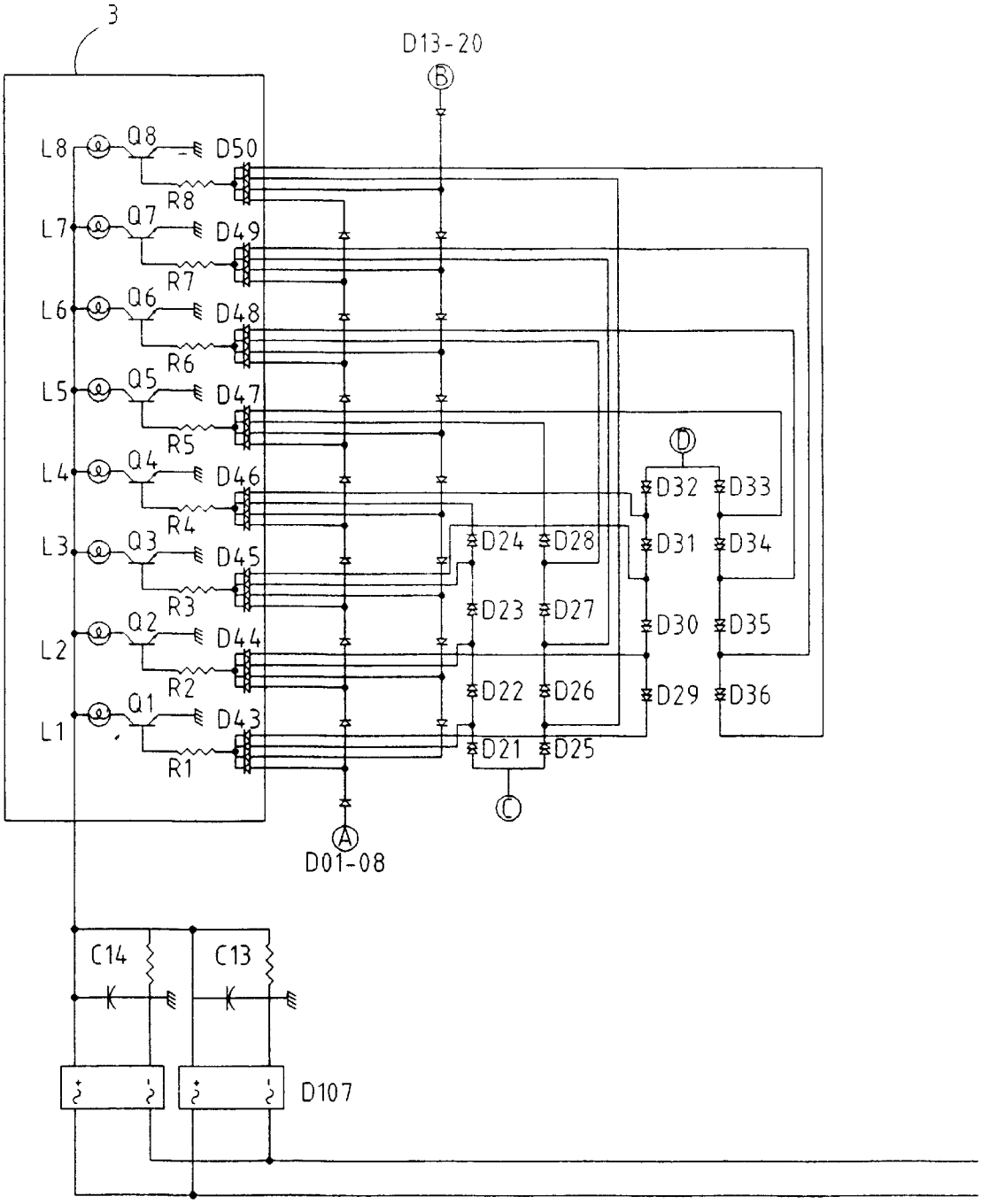
FIG. 2 is a circuit diagram of the second embodiment of the present invention.
Figure 2B:
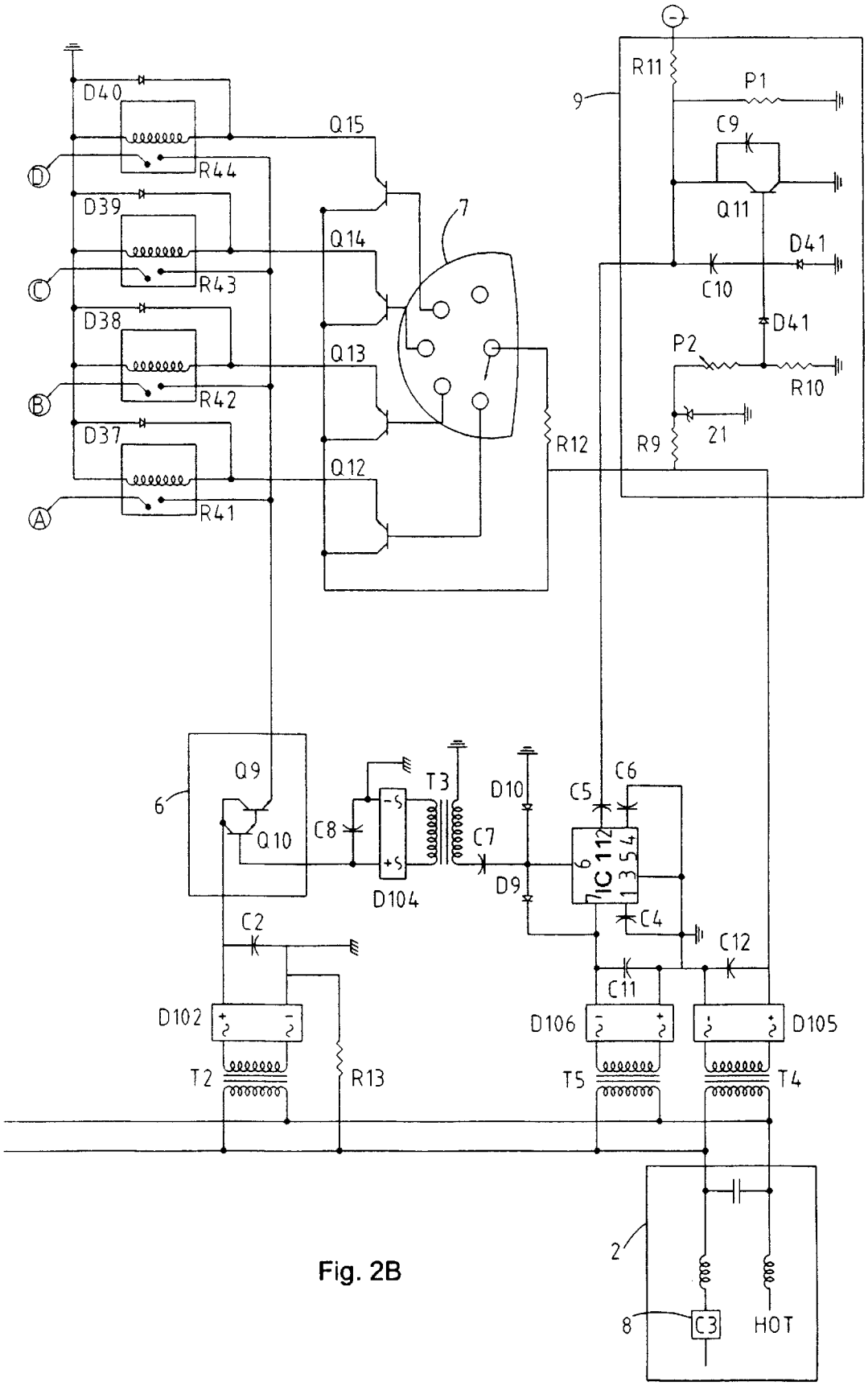
Figure 3:
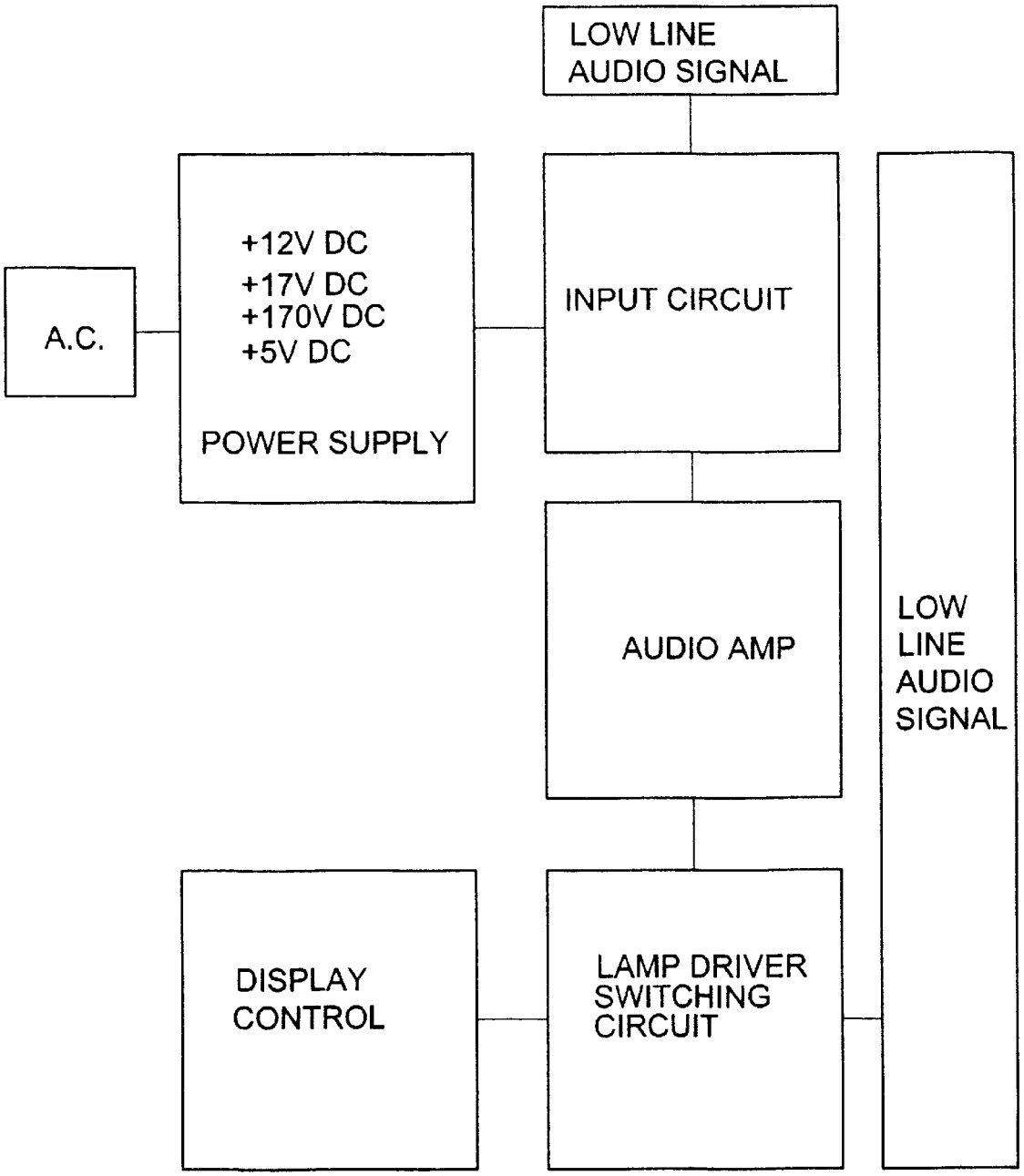
FIG. 3 is a block diagram of the second embodiment of the present invention.

FIGS. 2 and 3 illustrate a second embodiment of the present invention wherein the circuit design provides four independent patterns for illuminating lamps L1–L8. Where the components of FIG. 2 are the same as the corresponding component of FIG. 1, such component will be identified by the same reference numeral given in FIG. 1. Though four independent patterns are shown, it is to be understood any number of patterns may be designed with the present invention and are within the scope of the invention.

As seen in FIG. 2, diodes D11 and D12 have been removed an replaced with a volume control circuit 9. Volume control circuit 9 provides an adjustable means for limiting the audio signal eventually going to the audio amplifier IC1 for preventing saturating the input and overdriving amplifier IC1. Circuit 9 is adjustable to avoid be limited to +/−0.6 volts as with diodes D11 and D12. Circuit 9 is comprised of resistors R9, R10 and R11, potentiometers P1 and P2, zener diode Z1, diodes 41 and 42, capacitors C9 and C10 and transistor Q11. Potentiometer P1 provides a volume control independent from the rest of circuit 9, while potentiometer P2 biases transistor Q11 to fully on or off (200 mV below turn on at 0.4V). 5.6 volts zener diode Z1 regulates the voltage drop. Thus, audio signal voltages higher than 0.2 volts will cause circuit 9 to shunt the audio signal to ground.

Fuse F1 of FIG. 1, is seen replaced by a circuit breaker 8 in FIG. 2. However, it is to be understood that a fuse could be utilized with the circuit of FIG. 2 and that a circuit breaker could be utilized with the circuit of FIG. 1.

A pair of bridge rectifiers D107 and D108 with associated capacitors, C13 and C14, respectively, are provided for supplying power to the lamp output network 3. In lieu of bridge rectifiers D107 and D108, a single large bridge rectifier (16 amps) may be provided. In addition, a pair of bridge rectifiers D105 and D106 with associated capacitors C12 and C11 and transformers T4 and T5, respectively, are provided. Rectifier D105 supplies power (12 volts) to the relays RY1–RY4, while rectifier D106 supplies power to the audio amplifier.

Transformer T2, capacitor C2 and bridge rectifier D102 of the second embodiment function similar to transformer T2, capacitor C2 and bridge rectifier D102 of FIG. 1. The second embodiment is also provided with a bleed resistor R13 for static voltage which complete the ground (chassis back to AC line).

Switch 7 is provided for choosing one of the four independent patterns (labeled A, B, C and D) for illuminating lamps L1–L8. If position A on switch 7 is chosen, transistor Q12 is triggered thus energizing relay RY1 which causes the pulsed DC received from the darlington driver network 6 to be on the line A. Once on the line A, lamps L1–L8 are illuminated similar to and create the same lighting pattern as the lamps L1–L8 in the first embodiment. When switch 7 is in position A, relays RY2–RY4 are off and corresponding diodes D38–D40 are provided to avoid damaging relays RY2–RY4 when they are turned off due to instantaneous current flow. Diodes D38–D40 are connected reverse bias across the coil of relays RY2–RY4, respectively, to provide a current flow path to ground. Diode 37 performs the same function as diodes D38–D40 to protect relay RY1 when switch 7 is moved to any position other than position A.

When switch 7 is in position B, relays RY1, RY3 and RY4 will be off and relay RY2 will be energized, by the triggering of transistor Q13, causing the pulsed DC received from the darlington driver network 6 to be on the line B. In this position, the lamps L1–L8, are illuminated in a reverse pattern from position A. Thus, L8 is illuminated first, followed by L7, L6, etc, in a similar way as position A but in reverse order.

When switch 7 is in position C, relays RY1, RY2 and RY4 will be off and relay RY3 will be energized, by the triggering of transistor of Q14, causing the pulsed DC received from the darlington driver network 6 to be on the line C. In this position, lamps L1 and L8 begin to illuminate at the same time followed by lamps L2 and L7 illuminating at the same time, etc. With this position, the lamps illuminate from the end lamps (L1, L8) inward, at the same time, to create a unique visual pattern.

Lastly, when switch 7 is position D, relays RY1–RY3 will be off and relay RY4 will be energized, by the triggering of transistor of Q15, causing the pulsed DC received from the darlington driver network 6 to be on the line D. In this position, lamps L4 and L5 begin to illuminate at the same time followed by lamps L3 and L6 illuminating at the same time, etc. With this position, the lamps illuminate from the center lamps (L4, L5) outward, at the same time, to create a unique visual pattern. As seen on lines C and D, double diodes D21–D36 are provided. Since lines C and D will have two lamps illuminating at the same time, these double diodes are needed to provide the same voltage to each of the lamps as lines A and B.

Blocking diodes D43–D50, each containing four diodes, are also seen in FIG. 2. Blocking diode D43 is associated with lamp L1, blocking diode D44 is associated with lamp L2, etc. Each of the four diodes corresponds to lines A, B, C, D. If switch 7 is on position A, the first of the four diodes, for each blocking diode, will allow current to pass while the remaining three diode prevent or block current flow. Similarly, if switch 7 is on position B, the second of the four diodes, for each blocking diode, will allow current to pass while the remaining three diode prevent or block current flow. If switch 7 is on position C, the third of the four diodes will allow current to pass and if switch 7 is on position D, the fourth of the four diodes will allow current to pass.

Therefore, if the circuit shown in FIG. 2 is disposed within a housing structure, with lamp L1 at the bottom of the housing and lamp L8 at the top, in position A the lamps would illuminate upward starting from bottom (L1) to top (L8), in position B the lamps would illuminate downward starting from top (L8) to bottom (L1), in position C the lamps would illuminate inward starting from the top (L8) and bottom (L1) at the same time, and in position D the lamps would illuminate outward starting from lamps L4 and L5 at the same time.

In use, sound is converted into an electrical signal by audio input 1 and fed into the capacitively coupled audio amplifier IC1 which amplifies the electrical signal. The amplified signal is then fed through the isolation transformer T3 to the full-wave bridge rectifier D104. The isolation transformer T3 is inserted to prevent shock hazards and isolates the chassis ground from the hot ground. Rectifier D104 converts the amplified AC signal to a pulsed DC signal. The pulsed DC signal is fed to the darlington driver network 6 which amplifies the pulsed DC signal. Switch 7 is set to one of the four positions A through D, depending on which light pattern is desired.

If switch 7 is set to position A, when the pulsed DC signal exceeds a voltage of 1.2 volts (0.6 volts to conduct diode D1 and 0.6 volts to overcome the transistor Q1 junction), lamp L1 becomes illuminated. An additional 1.2 volts will begin to illuminate lamp L2. Similarly, each additional 1.2 volts will start to illuminate the next lamp in the lamp output network 3. Furthermore, because the lamps and associated circuitry are connected in parallel to each other, when a voltage is large enough to begin illuminating a lamp in the network 3, the lamps previously lit in network 3 still increase and fluctuate in brightness/intensity from the increase in voltage to the previous lamps. For example, a voltage output of 3.6 volts from the darlington driver network 6, would be seen as 3.6 volts at lamp L1, 2.4 volts at lamp L2 and 1.2 volts at lamp L3.

If switch 7 is set to position B, when the pulsed DC signal exceeds a voltage of 1.2 volts (0.6 volts to conduct diode D13 and 0.6 volts to overcome the transistor Q8 junction), lamp L8 becomes illuminated. An additional 1.2 volts will begin to illuminate lamp L7. Similarly, each additional 1.2 volts will start to illuminate the next lamp L6, etc., in the lamp output network 3. Furthermore, because the lamps and associated circuitry are connected in parallel to each other, when a voltage is large enough to begin illuminating a lamp in the network 3, the lamps previously lit in network 3 still increase in brightness/intensity from the increase in current to the previous lamps. For example, a voltage output of 3.6 volts from the darlington driver network 6, would be seen as 3.6 volts at lamp L8, 2.4 volts at lamp L7 and 1.2 volts at lamp L6.

If switch 7 is set to position C, when the pulsed DC signal exceeds a voltage of 1.8 volts (1.2 volts to conduct double diodes D21 and D25 and 0.6 volts to overcome the transistors Q1 and Q8 junctions), lamps L1 and L8 become illuminated. An additional 1.8 volts will begin to illuminate lamps L2 and L7. Similarly, each additional 1.8 volts will start to illuminate the next lamps (L3, L6) in the lamp output network 3. Furthermore, because the lamps and associated circuitry are connected in parallel to each other, when a voltage is large enough to begin illuminating a pair of lamps in the network 3, the lamps previously lit in network 3 still increase in brightness/intensity from the increase in current to the previous lamps. For example, a voltage output of 5.4 volts from the darlington driver network 6, would be seen as 5.4 volts at lamps L1 and L8, 3.6 volts at lamp L2 and L7, and 1.8 volts at lamps L3 and L6.

If switch 7 is set to position D, when the pulsed DC signal exceeds a voltage of 1.8 volts (1.2 volts to conduct double diodes D32 and D33 and 0.6 volts to overcome the transistors Q4 and Q5 junctions), lamps L4 and L5 become illuminated. An additional 1.8 volts will begin to illuminate lamps L3 and L6. Similarly, each additional 1.8 volts will start to illuminate the next lamps (L2, L7) in the lamp output network 3. Furthermore, because the lamps and associated circuitry are connected in parallel to each other, when a voltage is large enough to begin illuminating a pair of lamps in the network 3, the lamps previously lit in network 3 still increase in brightness/intensity from the increase in current to the previous lamps. For example, a voltage output of 5.4 volts from the darlington driver network 6, would be seen as 5.4 volts at lamps L4 and L5, 3.6 volts at lamp L3 and L6, and 1.8 volts at lamps L2 and L7.

FIGS. 4 through 8 illustrate a third embodiment of the present invention wherein the circuit design provides the four independent patterns discussed in the second embodiment for illuminating lamps L1–L8 or lamps L1A–L8A, as well as providing for a chase pattern and an alternating pattern. The alternating pattern allows the four independent patterns of the second embodiment to occur one after each other and to continue as such until terminated by the user or a different pattern is selected. Though four independent patterns and the chase pattern are shown, it is to be understood any number of patterns may be designed with the present invention and are within the scope of the invention.

Figure 4:
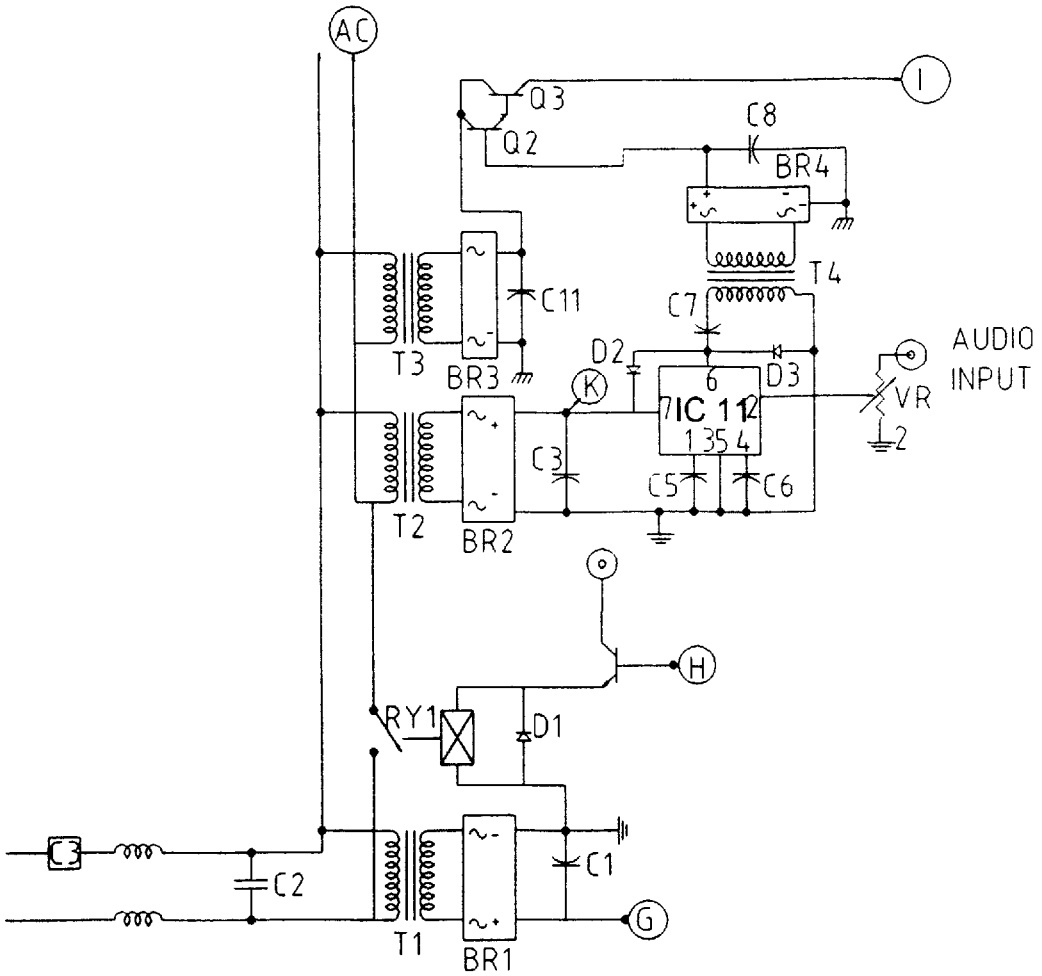
FIG. 4 is a circuit diagram of the power supply and audio amp portion of a third embodiment of the present invention.

As seen in FIG. 4, the volume control circuit 9 of FIG. 2 has been replaced with a potentiometer VR2 which acts a volume control. A circuit breaker CB similar to circuit breaker 8 in FIG. 2 is provided. The remaining components of the second embodiment prevention network are also provided in the third embodiment of the present invention and include AC line filter L1 and capacitor C2 (both shown in FIG. 4). However, it is to be understood that a fuse, FIG. 1, could be utilized with the third embodiment in lieu of circuit breaker CB.

A standby circuit (diode D1, relay RY1, transistor Q1, FIG. 4) is provided. When push-on/push-off switch S8 (FIG. 6) is pushed "on," 12 volts are sent to the base of transistor Q1 (FIG. 4), which ultimately closes relay RY1 to turn the unit on. Pushing standby switch S8 again opens RY1, causing the unit to be in standby mode waiting to be turned on again. Thus, the unit can be in idle mode and drawing minimal current, without having to unplug the unit from the wall outlet.

Transformer T3, capacitor C4 and bridge rectifier BR3 of the third embodiment function similar to transformer T2, capacitor C2 and bridge rectifier D102 of FIG. 2.

A pair of bridge rectifiers BR01 and BR02 (FIG. 5) with their associated capacitor C01 are provided for supplying power to the lamp output network 350. Rectifiers BR01 and BR02 are similar to rectifiers D107 and D108 of FIG. 2. In lieu of bridge rectifiers BR01 and BR02, a single large bridge rectifier (16 amps) may be provided.

As seen in FIG. 4, a second pair of bridge rectifiers BR1 and BR2 with associated capacitors C1 and C3 and transformers T1 and T2, respectively, are provided. Rectifier BR1 supplies power (12 volts) to the standby relay RY1, via power switch S9.

Figure 5:
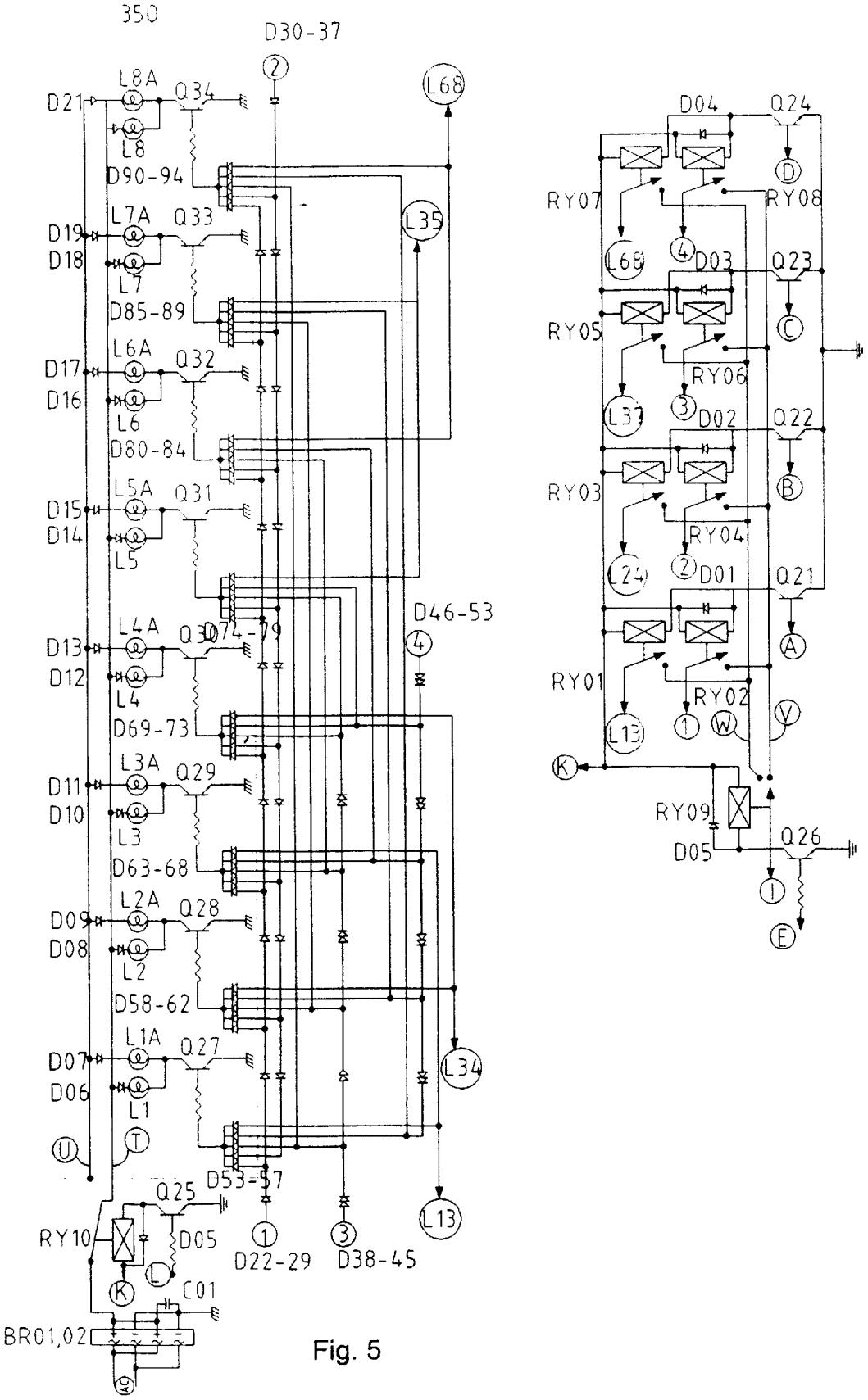
FIG. 5 is a circuit diagram of the lamp driver/relay portion of the third embodiment of the present invention.

As seen in FIG. 5, two lamps (L1 and L1A or L2 and L2A, etc.) are provided on each driver transistor. The two lamps are independent of each other. Relay RY10 is normally open, supplying high voltage, 180 volts, to line T to illuminate lamps L1–L8 in accordance with the invention. Thus, normally, line T has 180 volts controlling lamps L1–L8 and relay RY10 is in the off stage. Preferably, lamps L1–L8 are associated with a first set of color lights, and lamps L1A–L8A are associated with a different set of color lights. For example, regular colors, such as green, red, blue, etc. can be utilized for lamps L1–L8, while more pastel colors can be utilized to lamps L1A–L8A. Thus, the user can switch back and forth depending on the type of music being received through the audio input.

Thus, a user, by pushing switch S9, which is operatively associated with relay RY10 can switch between two sets of color light sets. Pushing switch S9 engages relay RY10 which puts the 180 volts on line U, which controls lamps L1A–L8A. Relay RY10 engages only one line (T or U) at a time. Relay RY10 prevents both bulbs (L1 and L1A) from coming on at the same time. Blocking diodes D06–D21 are provided to prevent current from running back through one lamp so when the associated transistor (Q27–Q34) is pulled to ground, only one lamp has a current flow.

Relay RY10 is controlled by transistor Q25, which is operatively associated with switch S9. Switch S9 is a push button switch which supplies power to the base of transistor Q25, which closes relay RY10, thus supplying the voltage on line U associated with lamps L1A–L8A. By pushing switch S9 again, relay RY10 opens, which causes the voltage to be provided on line T which is associated with lamps L1–L8. Thus, switch S9 determines whether you get the lamps associated with line T (L1–L8) or the lamps associated with line U (L1A–L8A).

Figure 6:
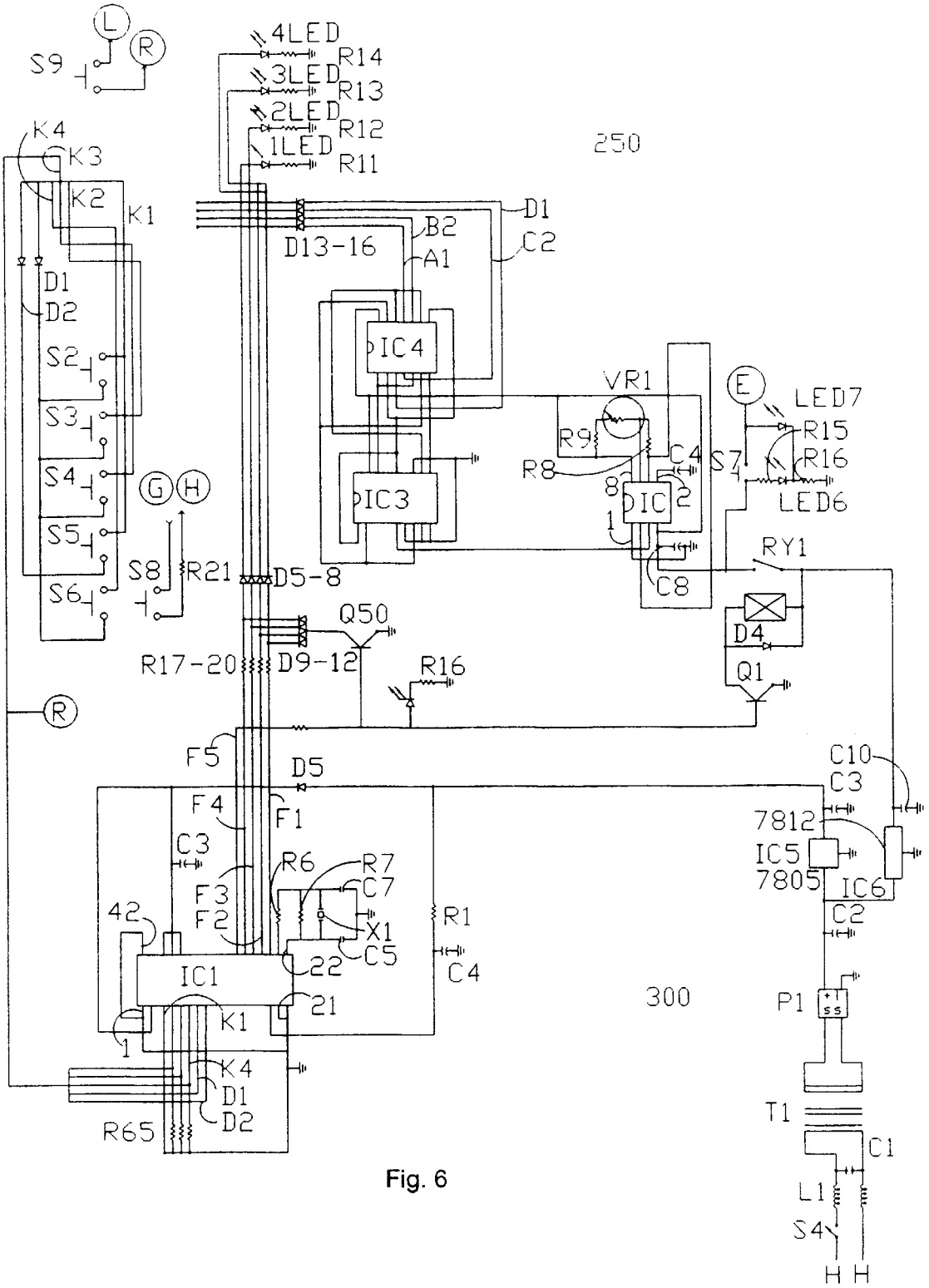
FIG. 6 is a circuit diagram of the controller portion of the third embodiment of the present invention.
Figure 7:
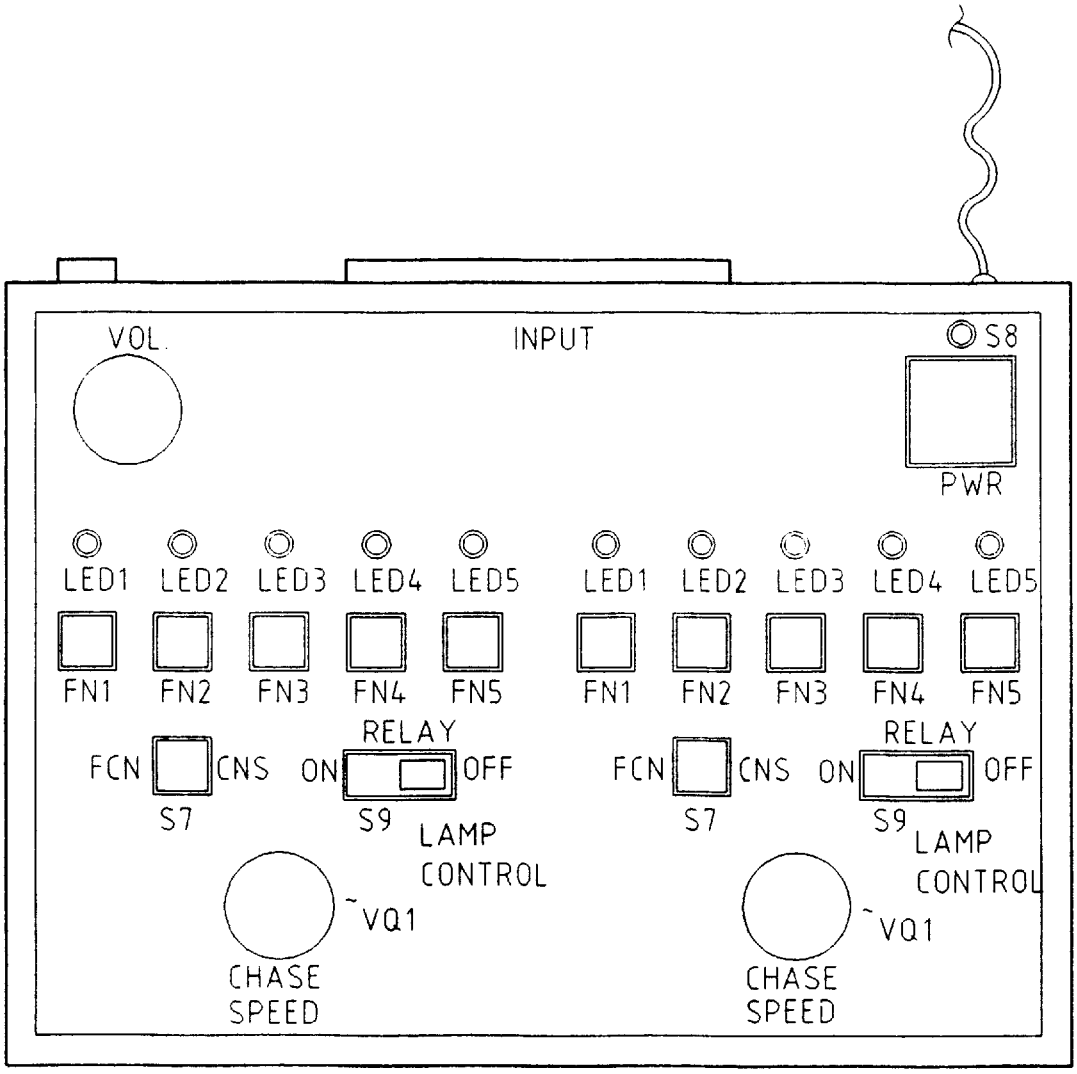
FIG. 7 is a front view of the controller housing, illustrating controls for two separate controllers each operating its own light display.
Figure 8:
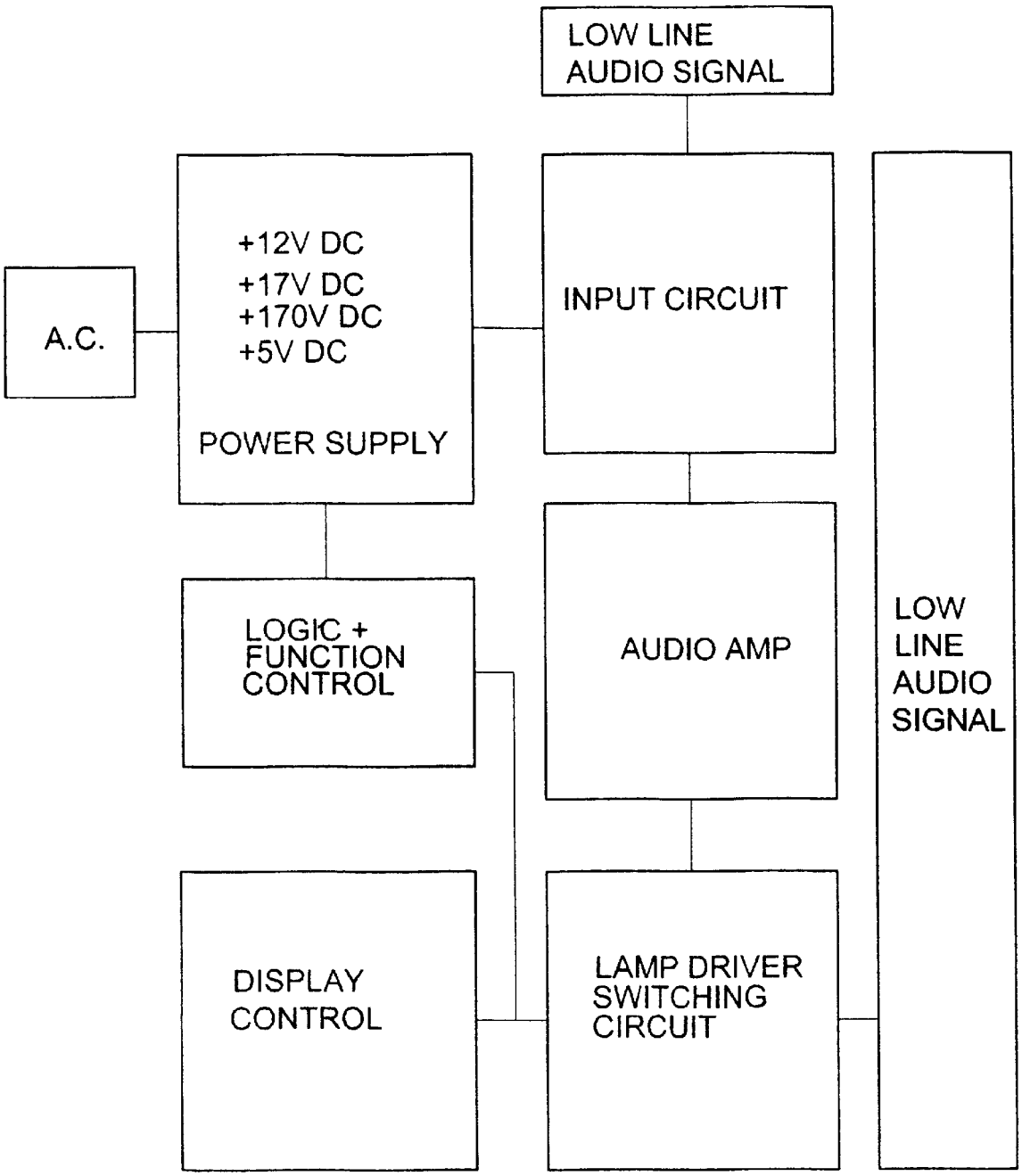
FIG. 8 is a block diagram of the third embodiment of the present invention.

Functions 1 through 4, by hitting switches S2–S5, respectively, engage transistors Q21–Q24, respectively to close their associated relay RY02, RY04, RY06 and RY08. Function 5 (switch S6) automatically closes one of the relays, via signals from microprocessor IC1. Microprocessor IC1 uses serial data to toggle the switches. The switch data line is shown as R (FIG. 6). Microprocessor prevents any two of the switches (S2–S5) from being on at any one time. Any selected input gives only one selected output.

Lines A, B, C and D go to transistors Q21, Q22, Q23 and Q24, respectively, to drive one its associated relays RY01, RY02, RY03,RY04, RY05,RY06 and RY07,RY08, respectively. A ceramic resonator crystal oscillator 400 is provided as a clock to run microprocessor IC1. Circuit 400 consists of resistors R6 and R7, capacitors C7 and C8 and crystal X1.

Resistors R2–R5 are provided to prevent raising the line all the way up to five (5) volts, when one of the switches (S2–S6) is selected. Microprocessor IC1 might want to see only 1 volt, thus resistors R2–R5 prevent the voltage from going completely to five (5) volts, and instead cause the voltage to go to whatever selected voltage resistors R2–R5 are at.

Resistor R1 and capacitor C4 are associated with the microprocessor reset line to reactivate microprocessor IC1 at startup every time. Resistor R1 and capacitor C1 provide a timing circuit to delay the reset line from turning on microprocessor IC1, before the main power line comes up in order for microprocessor IC1 to function properly and preventing microprocessor IC1 from locking up. Every time microprocessor IC1 loses power, it has to be reset otherwise it locks up and becomes confused, The reset line is designed to delay (by resistor R1 and capacitor C4), and physically resets microprocessor IC1 every time it powers up. The only time constant power is not supplied to the microprocessor is when the main power switch to the invention is disconnected, which causes the whole invention to shut down.

Dropping diodes D1 and D2 are provided for the input lines back to microprocessor IC1. Data rides on the input lines R. When the desired one of switches S2–S6 is selected, current is allowed to flow only through the associated dropping diode to microprocessor IC1, which recognizes what "function" is desired and microprocessor begins to run the selected function. Switches S2–S5 are associated with patterns A,B,C and D (lines 1–4, FIG. 5), respectively, and switch S6 (function 5) tells microprocessor to ignore functions 1–4 (switches 2–5) and look at function 5 only.

When switch S2 (Function 1) is selected, microprocessor IC1 knows to puts out five (5) volts on line F1 and zero (0) volts on lines F2, F3 and F4, which in turn puts five (5) volts to transistor Q21 (FIG. 5) which turns on relay RY02 which drives function 1. Similarly, when switch S3 (Function 2) is selected, microprocessor IC1 puts out five (5) volts on line F2 and zero (0) volts on lines F1, F3 and F4, which in turn puts five (5) volts to transistor Q22, which turns on relay RY04 which drives function 2.

Selecting switch S4 (Function 3) causes microprocessor IC1 to supply five (5) volts on line F3 and zero (0) volts on lines F1, F2 and F4, which in turn supplies five (5) volts to transistor Q23 to turn on relay RY06 to drive function 3. Selecting switch S5 (Function 4) causes microprocessor IC1 to supply five (5) volts on line F4 and zero (0) volts on lines F1, F2 and F3, which in turn supplies five (5) volts to transistor Q24 to turn on relay RY08 to drive function 4. As a visual indicator, LED 1 is provided and illuminated when Function 4 is chosen. LED 2 is illuminated when Function 3 is chosen. LED 3 is illuminated when Function 2 is chosen. LED 4 is illuminated when Function 1 is chosen.

When switch S6 (Function 5) is selected, control is taken away from the user, and microprocessor IC1 proceeds to physically control the light patterns. LED 5 is illuminated when Function 5 is chosen. Function 5 tells microprocessor IC1 to put out five (5) volts on line F5, which is independent of lines F1–F4. To prevent one of the functions F1–F4 from operating at the same time Function 5 has been selected, transistor Q50 is provided to pulls lines F1–F4 to ground and thus blocked by diodes D5–D8, respectively. Thus, by selecting switch S6, manual control is shorted and automatic control is provided through a change circuit 250, discussed below. To leave Function 5, switch S6 (F5) is pressed again (reselected), causing manual control to be given back at the last selected function prior to choosing Function 5, which is one of the Functions 1 through 4.

By selecting (pressing) switch S6, microprocessor IC1 only knows to put five (5) volts on line F5. Transistor Q1 (FIG. 6) is triggered from the five (5) volt output place on line F5 by microprocessor IC1, circuit and close the relay which supplies power to the chaser and the indicator LEDs. The triggering of transistor Q1 turns on relay RY1 to drive change circuit 250. The pressing of switch S7 determines whether the alternating pattern or the chase pattern is chosen for display. In Function 5, LED 6 is illuminated to indicate that the alternating pattern is selected. The selection of Function 5 defaults to whatever position switch S7 last in. If the user is in alternating pattern and desires the chase pattern, switch S7 is selected, which illuminates LED 7, to indicate that the chase sequence has been selected and also turns LED 6 off. If the user is in chase pattern and desires the alternating pattern, switch S7 is selected, which illuminates LED 6, to indicate that the alternating pattern has been selected and also turns LED 7 off.

The selection (hitting) of switch S7 to select the chase sequence provides voltage along line E to transistor Q26 (FIG. 5) to turn on relay RY09 which switches the seventeen (17) volts DC supplied by bridge rectifier BR1 (FIG. 4) on line I from relays RY02, RY04, RY06 and RY08 to relays RY01, RY03, RY05 and RY07. Thus relays RY01, RY03, RY05 and RY07 are turned on and are associated with the chase circuit pattern (lines L1,3; L2,4; L5,7 and L6,8; respectively). In either pattern of function F5 (chase or alternating), power is supplied to transistors Q21, Q22, Q23 and Q24 through change circuit 250. Change circuit 250 consists of filter capacitor C8, capacitor C9, resistors R8 and R9, potentiometer VR1, 555 timer IC2, dual "D" flip/flop with set/reset IC3 and quad two-input NOR gate IC4. Thus, when in Function 5, switch S7 determines whether the seventeen (17) volts DC is provided on line V for use by relays RY02, RY04, RY06 and RY08 (alternating pattern) or on line W for use by relays RY01, RY03, RY05 and RY07 (chase pattern). If not in Function 5, the seventeen (17) volts DC is always provided to line V.

Dual flip/flop IC3 and NOR gates IC4 put out a high and low sequencing which ultimately results in the taking one out of the four lines A1, B1, C1 or D1 high, while pulling the other three low. After a set time controlled by potentiometer VR1, the next consecutive line is pulled high and the remaining three low. Thus, in any function (Function 1 through Function 5) only one of the transistors Q21, Q22, Q23 or Q24 receives voltage at a time. In functions 1 through 4, the seventeen (17) volts will only be provided on line V. However, in Function 5, the seventeen (17) volts can be on either line V or W, depending on switch S7, and which line the voltage is on determines whether the pattern will be alternating or chase.

In Function 5, potentiometer VR1 determines the rate of change in which change circuit 250 pulls the next line of lines A1, B1, C1 and D1 high and the remaining three low. Potentiometer VR1 through the 555 timer (IC2) of change circuit 250 controls at what speed the alternating light patterns A–D switches from pattern to pattern or the chase pattern switches lamps. Thus, potentiometer VR1 determines in the alternating pattern how long pattern A is displayed before switching to pattern B and continues to determine how long pattern B will be displayed before switching to pattern C, etc. After pattern D is displayed for the set time, circuit 250 starts over with pattern A. If the chase pattern has been selected, potentiometer VR1 determines how long lamps L1 and L3 (L1A and L3A) remain illuminated before switching to lamps L2 and L4 (L2A and L4A) and continues to determine how long lamps L2 and L4 (L2A and L4A) remain illuminated before switching to lamps L5 and L7 (L5A and L7A), etc. After lamps L6 and L8 (L6A and L8A) are displayed for the set time, circuit 250 starts over with lamps L1 and L3 (L1A and L3A).

Change circuit 250 can time out from a half (½) second up to twenty (20) seconds. Each time circuit 250 times out, it starts recounting and continuously times out and restart over and over until a function other the Function 5 is selected.

A conventional power supply circuit 300 for supplying power to microprocessor IC1 is provided and includes on/off switch S1, line filter L1, spike capacitor C1, transformer T1, bridge rectifier P1, bridge filter cap C2, 5-volt 7805 regulator IC5, 12-volt 7812 regulator, and filter caps C3 and C10 which are provided to clean up the supply line.

As stated above, switches S2 through S5, related to Functions 1 through 4 on controller 500 (FIG. 7), are provided for choosing and activating one of the four independent patterns (labeled A, B, C and D, respectively) for illuminating lamps L1–L8 or lamps L1A–L8A in the desired pattern (the choice of set of lamps is discussed in detail below) . Switch S6 relates to function 5 on controller and provides either for the alternating pattern or the chase pattern on lamps L1–L8 or lamps L1A–L8A. Switch S7 determines whether the alternating pattern or the chase pattern is selected when function 5 has been selected. The chase pattern provides for lamps L1 and L3 (L1A and L3A) to be simultaneously lit for a given period, then lamps L2 and L4 (L2A and L4A) are lit, then lamps L5 and L7 (L5A and L7A) and lastly (L6 and L8), thus, creating a chase effect.

As discussed above LEDs 1–7 (FIG. 6) are provided to indicate to the user which pattern has been selected and is currently running. LED 1 corresponds to pattern A (Function 1), LED 2 corresponds to pattern B (Function 2), LED 3 corresponds to pattern C (Function 3), LED 4 corresponds to pattern D (Function 4), and LED 5 corresponds to Function 5. As discussed above when Function 5 is selected the system is running either the alternating pattern or the chase pattern. Thus, in addition to lighting LED 5 when function 5 has been activated, either LED 6 or LED 7 when also be illuminated to indicate whether the alternating pattern (LED 6) or the chase pattern (LED 7) has been selected.

If pattern A, switch S2 selected, transistor Q21 is triggered thus energizing relays RY01 or RY02 which causes the pulsed DC received from the darlington driver network (Q2 and Q3 FIG. 4 Elec. 1) to be on the line A (1). Once on line A, lamps L1–L8 (l1A–L8A) are illuminated similar to and create the same lighting pattern as the lamps L1–L8 in the second embodiment. In pattern A (1), relays RY03–RY08 are off and corresponding diodes D02–D04 are provided to avoid damaging relays RY03–RY08 when they are turned off due to instantaneous current flow. Diodes D02–D04 are connected reverse bias across the coil of relays RY2–RY4, respectively, to provide a current flow path to ground. Diode D01 performs the same function as diodes D02–D04 to protect relay RY01 and RY02 when pattern A is not desired.

In pattern B, relay RY03 and RY04 are energized, by the triggering of transistor Q22, causing the pulsed DC received from the darlington driver network to be on the line B (2). In this position, the lamps L1–L8 (L1A–L8A), are illuminated in a reverse pattern from pattern A. Thus, L8 (L8A) is illuminated first, followed by L7 (L7A), L6 (L6A), etc, in a similar way as pattern A but in reverse order.

In pattern C, relay RY05 and RY06 are energized, by the triggering of transistor of Q23, causing the pulsed DC received from the darlington driver network to be on the line C (3). In this position, lamps L1 (L1A) and L8 (L8A) begin to illuminate at the same time followed by lamps L2 (L2A) and L7 (L7A) illuminating at the same time, etc. With this position, the lamps illuminate from the end lamps (L1 or L1A and L8 or L8A) inward, at the same time, to create a unique visual pattern.

In pattern D, relay RY07 and RY08 are energized, by the triggering of transistor of Q24, causing the pulsed DC received from the darlington driver network to be on the line D (4). In this position, lamps L4 (L4A) and L5 (L5A) begin to illuminate at the same time followed by lamps L3 (L3A) and L6 (L6A) illuminating at the same time, etc. With this position, the lamps illuminate from the center lamps (L4 or L4A and L5 or L5A) outward, at the same time, to create a unique visual pattern. As seen on lines 3 (pattern C) and 4 (pattern D), double diodes D38–D45 and D46–D57, respectively, are provided. Since lines 3 and 4 have two lamps illuminating at the same time, the respective double diodes are needed to provide the same voltage to each of the lamps as lines 1 (pattern A) and 2 (pattern B).

Blocking diodes D53–D57, D58–D62, D64–D68, D69–D73, D75–D79, D80–D84, D85–D89 and D90–D94 are also shown in FIG. 5. Blocking diodes D53–D57 are associated with lamp L1 and L1A, blocking diodes D58–D62 are associated with lamp L2 and L2A, etc. The first four diodes in each set corresponds to lines 1 (pattern A), 2 (pattern B), 3 (pattern C), and 4 (pattern D). The last diode D57, D62, D68, etc., in each set of five diodes, is associated with Function 5, in either the alternating pattern or the chase pattern.

When pattern A (Function 1) is selected, the first of the five diodes (D53, D58, D64, etc.), for each set of blocking diodes, allows current to pass while the remaining four diodes prevent or block current flow. Similarly, if pattern B (Function 2) is selected, the second of the five diodes (D54, D59, D65, etc.), for each set of blocking diodes, allows current to pass while the remaining four diodes prevent or block current flow. If pattern C (Function 3) is selected, the third of the five diodes (D55, D60, D66, etc.) allows current to pass while the remaining four diodes prevent or block current flow. If pattern D (Function 4) is selected, the fourth of the five diodes (D56, D61, D67, etc.) allows current to pass while the remaining four diodes prevent or block current flow. Lastly, if either the alternating pattern or the chase pattern of Function 5 is selected, the fifth of the five diodes (D57, D62, D68, etc.) allows current to pass while the remaining four diodes prevent or block current flow.

Therefore, if the lamps (L1–L8 and L1A–L8A) are disposed within a housing structure (not shown), with lamp L1 and L1A at the bottom of the housing and lamp L8 and L8A at the top, in position A the lamps would illuminate upward starting from bottom (L1 or L1A) to top (L8 or L8A), in position B the lamps would illuminate downward starting from top (L8 or L8A) to bottom (L1 or L1A), in position C the lamps would illuminate inward starting from the top (L8 or L8A) and bottom (L1 or L1A) at the same time, and in position D the lamps would illuminate outward starting from lamps (L4 or L4A) and (L5 or L5A) at the same time. In the chase pattern of Function 5, lamps L1 and L3 (L1A and L3A) would light, then L2 and L4 (L2A and L4A), then L5 and L7 (L5A and L7A), then L6 and L8 (L6A and L8A).

In use, sound is converted into an electrical signal by the audio input and fed into the capacitively coupled audio amplifier IC11 (FIG. 4) which amplifies the electrical signal. The amplified signal is then fed through an isolation transformer T4 to the full-wave bridge rectifier BR4. Isolation transformer T4 is inserted to prevent shock hazards and isolates the chassis ground from the hot ground. Rectifier BR4 converts the amplified AC signal to a pulsed DC signal. The pulsed DC signal is fed to the darlington driver network (Q2 and Q3) which amplifies the pulsed DC signal. One of the five functions on controller 500 is selected by depressing the associated switch S2–S6, depending on which light pattern is desired. Lamps L1–L8 or L1A–L8A illuminate similar to L1–L8 of the second embodiment for the four patterns associated with the selection of function one through four.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

The following is a component parts list of the disclosed embodiment.

PARTS LIST

First Embodiment

L1–L8—25 W, 120V Lamp
Q1–Q9—MJ12005
Q10—D44H11
D1–D12—1000VPIV, 2.5 A Diode
R1–R8—68 Ohms, ½ W resistor
T1—12V 1 Amp transformer
T2—25.2 VCT at 2 Amp Transformer
T3—1000 Ohm CT to 8 Ohm Audio Transformer
C1—470 micro farad at 200 V—capacitor
C2 and C3—1000 micro farad at 35 V—capacitor
C4—47 micro farad at 25 V—capacitor
C5 and C8—2.2 micro farad at 50 V—capacitor
C6—220 micro farad at 25 V—capacitor
C7—1000 micro farad at 25 V—capacitor
C101—0.22 micro farad at 1000 V—capacitor
D101, D102 and D103—8 A bridge rectifier
D104—4 A bridge rectifier
F1—6 A fuse
L101—AC line filter
IC1—TA8213

Second Embodiment

L1–L8—25 W, 120V Lamp
Q1–Q9—MJ12005 transistors
Q10, Q12–Q15—D44H11 transistors
Q11—ECG123 transistor
D1–D50—2 Amp general purpose diodes
R1–R8—68 Ohms, ½ W resistors
R9, R10 and R12—100 Ohms, ½ W resistors
R11—4.7k Ohms, ½ W resistor
R13—2.2M Ohms resistor
T1—12V 1 Amp transformer
T2—25.2 VCT at 2 Amp Transformer
T3—1000 Ohm CT to 8 Ohm Audio Transformer
C1—470 micro farad at 200 V—capacitor
C2 and C3—1000 micro farad at 35 V—capacitor
C4—47 micro farad at 25 V—capacitor
C5 and C8—2.2 micro farad at 50 V—capacitor
C6—220 micro farad at 25 V—capacitor
C7—1000 micro farad at 25 V—capacitor
C9—0.01 micro farad at 100 V—capacitor
C10—4.6 micro farad at 50 V—capacitor
C101—0.22 micro farad at 1000 V—capacitor
D101, D102 and D103—8 A bridge rectifier
D104—4 A bridge rectifier
CB—6 Amp circuit breaker
L101—AC line filter
IC1—TA8213

RY1–RY4—12 V 35 mA mini relay
Switch 7—6 position dual gauged switch
P1—100k Ohms dual gauged potentiometer
P2—1k Ohms ¼ W trim potentiometer
Z1—5.6V Zener diode Third Embodiment a. FIG. 4

C1—1000 micro farad at 35V
C2—0.22 micro farad at 1000V
C3—1000 micro farad at 35V
C4—1000 micro farad at 35V
C5—47 micro farad at 25V
C6—220 micro farad at 25V
C7—1000 micro farad at 25V
C8—2.2 micro farad at 50V
BR1 and BR2—8 amp, 1000V piv
BR3—4 amp, 1000V piv
D1, D2 and D3—2 amp, 600V
Q1 and Q2—D44H11
Q3—MJ12005
Ry1—TV5, 250V 5 A, coil 12V DC
T1 and T2—12V, 2 amp
T3—25.2 VCT, 2 amp
T4—1k ohm CT to 8 Ohm, audio transformer
CB—6 amp circuit breaker
L1—ac line filter
IC1—TA 8213
Vr1—25k ohm potentiometer
FIG. 5

D01 through D95—2 amp, general purpose diodes
Ry01 through Ry10—12V 35 mA mini relay
Q21 through Q 26—D44H11
Q27 through 34—MJ12005
BR01 and BR02—8 amp bridge rectifier
C01—470 micro farad at 200V DC
L1 through L8 and L1A through L8A—25 W incandescent lamps
FIG. 6

S1—on/off 5 amp toggle switch
S2 through S6—soft touch momentary switches
S7 and S8—push on/off switch
LED 1 through LED 7—red LEDs
R1—82k ohm ½ W
R2 through R5—100k Ohm ¼ W
R6 and R8—1k ohm
R7 and R9—1M ohm
R10 through R21—1k ohm ½ W
Ry1—12V mini relay
D1 through D16—2 amp general purpose
Q1—D44H11
IC1—LC6505C-4277
IC2—555
IC3—4013
IC4—4001
X1—EFO-A400K048, 400k Hz crystal
VR1—100k ohm potentiometer
C1—0.22 micro farad at 1 KV
C2 and C3—1000 micro farad at 35V
C4—1 micro farad at 50V
C5—1000 micro farad at 16V
C6—470 pico farad at 100V
C7—220 pico farad at 100V
C8 and C9—100 micro farad at 25V
C10—1000 micro farad at 25V

What we claim as new and desire to secure by Letters Patent of the United States is:

1. A device for producing a visual effect in rhythmic response to an audio input AC signal, the AC signal having a full bandwidth, said device comprising:

means for receiving the audio input AC signal;

means for amplifying the full bandwidth of the audio input AC signal received by said means for receiving;

means for isolating the audio input AC signal amplified by said means for amplifying;

means for converting the audio input AC signal amplified by said means for amplifying to a pulsing DC signal;

means for amplifying the pulsing DC signal converted by said means for converting;

a plurality of control circuits, each of said control circuits being driven by said means for amplifying the pulsing DC signal, each of said control circuits having a respective illumination means connected in circuit therewith;

means for supplying DC power to each of said illumination means;

means for supplying DC power to said means for amplifying the pulsed DC signal; and means for supplying DC power to said means for amplifying the audio input AC signal;

wherein when an output voltage from said means for amplifying is above a certain threshold level a first of said illumination means begins to become illuminated and with an increase in the output voltage additional illumination means begin to become illuminated while previously illuminated illumination means become brighter in intensity due to the increase of the output voltage;

wherein the intensity of said illumination means fluctuates in intensity in response to changes in the audio input signal.

2. The device of claim 1 further comprising means for limiting the audio input AC signal being fed to said means for amplifying the audio input AC signal.

3. The device of claim 1 further comprising means for blocking any DC signal from being fed to said means for amplifying the audio input AC signal.

4. The device of claim 1 further comprising means for blocking any DC signal from being fed to said means for isolating the audio input AC signal.

5. The device of claim 1 wherein said means for amplifying the audio input AC signal is an audio amplifier.

6. The device of claim 1 wherein said means for amplifying the pulsed DC signal is a darlington network.

7. The device of claim 1 wherein said illumination means are lamps.

8. The device of claim 1 further comprising means for inhibiting and reducing RF traveling on a AC main power line.

9. The device of claim 1 further comprising means eliminating spikes that occur when initially plugging into a AC main power line.

10. The device of claim 1, further including means for determining an order for illuminating said illumination means.

11. The device of claim 10, wherein said means for determining is a switch means, said switch means turning on a selected one of several different light pattern circuits, the selected light pattern circuit receiving the pulsed DC signal for illuminating said plurality of illumination means.

12. A device for producing a visual effect in rhythmic response to an audio input AC signal, the AC signal having a full bandwidth, said device comprising:

means for receiving the audio input AC signal;

means for amplifying the full bandwidth of the audio input AC signal received by said means for receiving;

means for isolating the audio input AC signal amplified by said means for amplifying;

means for converting the audio input AC signal amplified by said means for amplifying to a pulsing DC signal;

means for amplifying the pulsing DC signal converted by said means for converting;

a plurality of control circuits, each of said control circuits being driven by said means for amplifying the pulsing DC signal, each of said control circuits having a respective illumination means connected in circuit therewith;

means for supplying DC power to each of said illumination means;

means for supplying DC power to said means for amplifying the pulsed DC signal;

means for supplying DC power to said means for amplifying the audio input AC signal;

means for inhibiting and reducing RF traveling on a AC main power line;

means for eliminating spikes that occur when initially plugging into the AC main power line;

means for limiting the audio input AC signal being fed to said means for amplifying the audio input AC signal;

means for blocking any DC signal from being fed to said means for amplifying the audio input AC signal; and means for blocking any DC signal from being fed to said means for isolating the audio input AC signal;

wherein when an output voltage from said means for amplifying is above a certain threshold level a first of said illumination means begins to become illuminated and with an increase in the output voltage additional illumination means begin to become illuminated while previously illuminated illumination means become brighter in intensity due to the increase of the output voltage;

wherein the intensity of said illumination means fluctuates in intensity in response to changes in the audio input signal.

13. The device of claim 12 wherein said means for amplifying the audio input AC signal is an audio amplifier.

14. The device of claim 12 wherein said means for amplifying the pulsed DC signal is a darlington network.

15. The device of claim 12 wherein said illumination means are lamps.

16. The device of claim 12, further including means for determining an order for illuminating said illumination means.

17. The device of claim 10, wherein said means for determining is a switch means, said switch means turning on a selected one of several different light pattern circuits, the selected light pattern circuit receiving the pulsed DC signal for illuminating said plurality of illumination means.

18. A device for producing a visual effect in rhythmic response to an audio input AC signal, the AC signal having a full bandwidth, said device comprising:

means for receiving the audio input AC signal;

an audio amplifier for amplifying the full bandwidth of the audio input AC signal received by said means for receiving;

means for isolating the audio input AC signal amplified by said audio amplifier;

means for converting the audio input AC signal amplified by said audio amplifier means to a pulsing DC signal;

a darlington network for amplifying the pulsing DC signal;

a plurality of control circuits, each of said control circuits being driven by said means for amplifying the pulsing DC signal, each of said control circuits having a respective lamp connected in circuit therewith;

means for supplying DC power to each of said illumination means;

means for supplying DC power to said means for amplifying the pulsed DC signal;

means for supplying DC power to said means for amplifying the audio input AC signal;

means for inhibiting and reducing RF traveling on a AC main power line;

means for eliminating spikes that occur when initially plugging into the AC main power line;

means for limiting the audio input AC signal being fed to said means for amplifying the audio input AC signal;

means for blocking any DC signal from being fed to said means for amplifying the audio input AC signal; and means for blocking any DC signal from being fed to said means for isolating the audio input AC signal;

wherein when an output voltage from said means for amplifying is above a certain threshold level a first of said illumination means begins to become illuminated and with an increase in the output voltage additional illumination means begin to become illuminated while previously illuminated illumination means become brighter in intensity due to the increase of the output voltage;

wherein the intensity of said illumination means fluctuates in intensity in response to changes in the audio input signal.

19. The device of claim 18, further including switch means for turning on a selected one of several different light pattern circuits, the selected light pattern circuit receiving the pulsed DC signal for illuminating said plurality of illumination means.

* * * * *